United States Patent [19]

Pike

[11] 4,076,230

[45] Feb. 28, 1978

[54] PORTABLE, READILY STORABLE PATIENT TREATMENT TABLE

[75] Inventor: Allan R. Pike, Portland, Oreg.

[73] Assignee: Jerome S. Marger, Portland, Oreg. ; a part interest

[21] Appl. No.: 586,348

[22] Filed: Jun. 12, 1975

[51] Int. Cl.[2] ..... A47G 9/00

[52] U.S. Cl. ..... 269/328

[58] Field of Search ..... 269/322–328; 128/69, 70; 5/319, 325, 327 B, 337, 338

[56] References Cited

U.S. PATENT DOCUMENTS

| | | | |
|---|---|---|---|
| 2,041,087 | 5/1936 | Ocasek | 269/327 |
| 2,258,782 | 10/1941 | McKean | 269/328 |
| 2,579,783 | 12/1951 | Branto | 269/326 |
| 2,702,733 | 2/1955 | Lorang | 128/70 |
| 3,206,188 | 9/1965 | Douglass | 269/325 |
| 3,226,106 | 12/1965 | Johnson et al. | 269/325 |
| 3,411,766 | 11/1968 | Lanigan | 269/325 |
| 3,694,831 | 10/1972 | Treace | 5/327 B |
| 3,747,916 | 7/1973 | Benson | 269/328 |

FOREIGN PATENT DOCUMENTS

| | | | |
|---|---|---|---|
| 1,499,275 | 9/1967 | France | 128/70 |

*Primary Examiner*—Robert C. Watson

[57] ABSTRACT

A portable, readily storable patient treatment table includes a headrest section having an aperture contained therein which accepts and retains a patient's head in proper position within said aperture in a steadfast manner without the use of auxiliary retaining means.

9 Claims, 5 Drawing Figures

PORTABLE, READILY STORABLE PATIENT TREATMENT TABLE

BACKGROUND OF THE INVENTION

Patient treatment systems such as those on which patients lie on their back are generally unwildly and require extensive auxiliary equipment to maintain the patient in proper position during treatment.

In a non-analogus art, dental chairs in general use today are relatively large in size so that they are quite heavy and immobile. Because of space and cost limitations, only the specific number of pieces of dental equipment requisite to the practice of dentistry can be put onto the office. Therefore, the same large-size chair is used for adults of all sizes as well as for children. The above dental chairs, due to the imposing size, often intimidate younger patients. This of course provides particular problems for the dentist who has to work on their teeth.

The focal point for positioning patients in a standard dental chair is the patient's seat. But since these chairs accomodate both the largest adult and the smallest child, respectively, the position of their head, with respect to the chair, will vary drastically. When patients of varying sizes sit in conventional chairs, the location of their respective oral areas, with respect to the top and sides of the chair, will vary greatly making difficult even the most routine dental procedures. Thus, when smaller patients are seated in standard chairs, the relative difference in size between the patients and the chair in either an up-and-down or side-to-side direction is significant.

Prior art devices which are provided include, for example, U.S. Pat. Nos. 3,347,544 to Uffenorde, 3,747,916 to Benson, 2,684,064 to Thompson, and 2,702,733 to Larang, are employed for orthopedic surgery and accordingly are built for the patient to lie thereon with the front portion of their body resting on the surgical table.

SUMMARY OF THE INVENTION

The patient treatment system of the present invention is portable and quite maneuverable, as opposed to the prior art treatment systems which are heavy, cumbersome, and immobile. More specifically, the subject system is compact, can be moved from place-to-place, and are readily storable in an out-of-the-way part of the office of the actor, i.e., dentist, physician or the like. For purposes of further storability, the ends of the longitudinally-extending patient platform of the patient treatment system of this invention can be articulated in a downward arcuate path, with respect to the horizontal axis of the patient platform, for providing a smaller, readily storable, longitudinally-extending structure.

The subject system fixes the position of the patient while positioned on their back of the patient's body by first locating the rear portion of a patient's head within the confines of a headrest section, the headrest being preferable in the form of an elongated restraining annulus sized to accept the patient's head and hold it in place, deploying for this purpose only the weight of the patient's own body without any auxiliary means of restraint. More specifically, the patient's head, when positioned within the aperature formed in the headrest section is maintained within the aperature, at least partially below and preferably substantially below, the level of the upper surface of the patient platform. Thus, the patient is maintained in proper position relative to the actor during the performance of a given treatment procedure.

Since the headrest is narrower in it's lateral dimension than it's longifudinal dimension, there is significantly more accessibility to the patient because of a much closer proximity to the patient's head. Moreover, since the longitudinal distance from the top of the headrest to the patient's head is fixed, the distance from the patient is constant, thus providing a more effective working environment due to improved accessibility of the patient's head.

Finally, the height of the treatment system is adjustable, in a vertical direction with respect to the horizontal axis of the system, so that, for instance actors of any height or size, in a sitting position, can comfortably and efficiently work on the patient's head.

DETAILED DESCRIPTION OF PREFERRED EMBODIMENT

Figure 1:
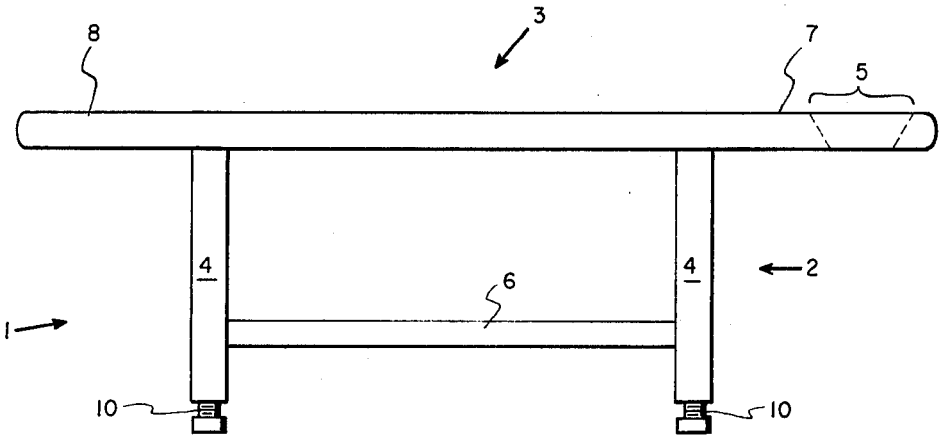
FIG. 1 is a side view of the patient treatment table of the present invention.
Figure 2:
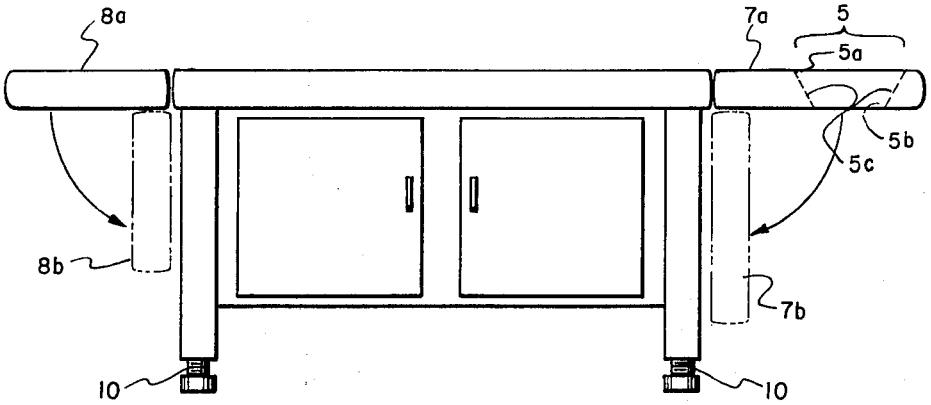
FIG. 2 is a side view of a preferred embodiment of the present invention including a storage cabinet.
Figure 3:
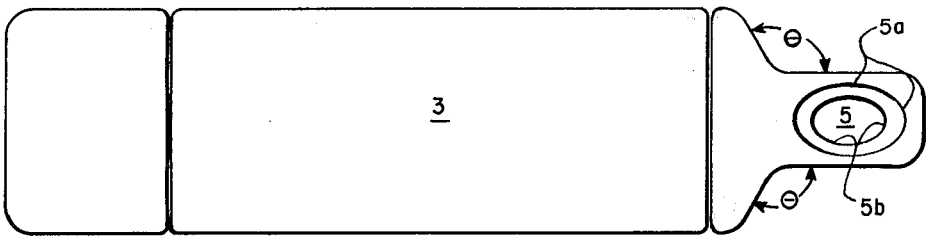
FIG. 3 is a top view of the embodiment of FIG. 2.

Referring to FIGS. 1 and 2, a portable, readily storable patient treatment system disgnated generally as 1, includes a base 2, which has a longitudinally extending patient platform 3 mounted thereon in a substantially horizontal plane above the level of the floor or other surface on which it resides. Preferably, as shown in FIG. 1, base 2 conprises a plurality of legs 4 which are reinforcably maintained in a substantially vertical alignment by bracing means 6 attached to the inner sides of each respective leg. The patient platform 3 includes a footrest section, upon which the patient's feet rest and at the other end, a headrest section 7 having an aperture 5 contained therein, which accepts and retains a patient's head in proper position, the preponderance of the patient's head being below the level of the upper surface of platform 3. When the patient's head resides within the headrest it is retained in a steadfast manner thereby fixing the position of the patient's body without the use of additional auxiliary retaining means. As shown in FIGS. 2 and 3, preferably, the diameter of aperture 5 narrows as it advances from the upper to the lower surface of headrest from a maximum at 5*a* to a minimum at 5*b* thus forming a tapered aperture 5*c*, which is preferably flexible in nature. Preferably the configuration of aperture 5 is similar in shape to that of the human head. The headrest section 7 is preferably elongated and protrudes outwardly from the base of the subject structure. The lateral diminsion of headrest 7 is less than ½ the lateral dimension of platform 3. As shown in FIG. 2, headrest angle $\theta$ is at least about 90°, and preferably at least up to about 120°, and more preferably up to about 150°.

More specifically, the headrest angle $\theta$ is defined as the angle formed between the longitudinally-extending side of the headrest section 7 and the lateral end of the base, respectively.

As a further feature of this invention, portable elevated head support 9 for maintaining the patient's head in an elevated position during the treatment process, which includes elevated headrest 9*b* for mating engagement within aperture 5 via inset means 9*c*. Height adjustment means 10 are provided for varying the level of the subject system. A threaded lift assembly, for example, or other like height adjustment means may be employed to vary the elevation of the patient treatment system. In addition, rollers or other similar means (not shown in the drawings) for providing ease of movement of the chair from it's stored to it's end (use) position.

Figure 5:
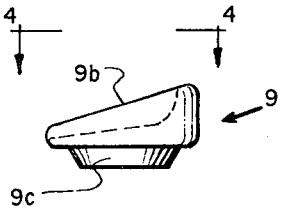
FIG. 5 is a side view of the head rest section of FIG. 4.
Figure 4:
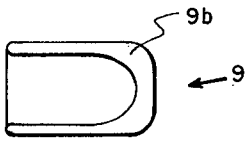
FIG. 4 is a top view of the removable head rest section.

In the preferred embodiment of FIG. 5, base 2 comprises cabinet for storing the equipment employed in providing the requisite patient Cabinets built of wood, metal, plastic, or other like materials can be used if they meet the strength parameters needed to properly maintain a patient on platform 3. Moreover, to further facilitate storage in a small area in a given dental office, headrest section 7*a* and footrest section 8*a* are pivotally attached for movement in a downward arcuate path until footrest section 8*a* is in position "8*b*," and headrest section 7*a* is in position "7*b*."

In use, the treatment system is moved from it's storage place and positioned in the appropriate area of the dentist's office. If the preferred embodiment of FIG. 5 is employed, headrest 7*a* and footrest 8*a* are moved to form patient platform 3 from articulated positions 7*b* and 8*b*, respectively. Height adjustment means 10 are moveably adoptable so that the actor, in the seated position, can easity practice in close proximity to the patient. Although the height variance of support top 3 is relatively small, from about 4 to 8 inches, it is sufficient to permit actors of any height, in the seated position, to be in proper position relative to the patient. If the prefered embodiment of FIG. 5 is employed, the instruments and associated equipment stored in the cabinet section are removed and the requisite procedures initiated.

I claim:

1. A portable, readily storable patient treatment system which comprises:

(a) a base;

(b) a longitudinally-extending patient platform mounted on said base in a substantially horizontal plane above the surface on which it resides;

(c) a footrest section upon which the patient's feet rest included at one end of said longitudinally-extending patient platform;

(d) a headrest section included at the other end of said longitudinally-extending patient platform, having an aperture containing therein, which accepts and retains a patient head in proper position within said aperture in a steadfast manner thereby maintaining the position of the patient's body in proper alignment without the use of auxiliary retaining means, the preponderance of the patient's head resting within said headrest section; and (e) a portable elevated head support, including insert means for mating engagement in said aperture, provided for maintaining the patient's head in an elevated position during said treatment process.

2. The patient treatment system of claim 1, wherein said headrest section is elongated and protrudes outwardly from said base.

3. The patient treatment system of claim 2, wherein the lateral dimension of said headrest is less than the lateral dimension of said patient platform.

4. The patient treatment system of claim 2, wherein the lateral dimension of said headrest is less than one-half the lateral dimension of said patient platform.

5. The patient treatment system of claim 1, wherein the headrest angle $\theta$ is at least about 90°.

6. The patient treatment system of claim 1, wherein the headrest contains a tapered aperture in which the diameter of said aperture narrows as it advances from the upper to the lower surface of said headrest.

7. The patient treatment system of claim 1, including means for adjusting the height of said patient treatment system, in only a vertical direction with respect to the horizontal axis of said system, so that actors of any height, in a sitting position can comfortably and efficiently work on a patient's head.

8. The patient treatment system of claim 1, wherein said headrest and footrest sections, respectively, are pivotally attached for movement in a downward arcuate path, with respect to the horizontal axis of said patient platform for providing a smaller readily storable longitudinally-extending structure.

9. The patient treatment system of claim 1, wherein said base comprises a cabinet for storing the equipment employed in providing the requisite patient services.

* * * * *